United States Patent [19]

Dankman et al.

[11] 4,267,551

[45] May 12, 1981

[54] MULTI-MODE DOLL

[76] Inventors: Scott Dankman; Richard C. Levy; Bryan L. McCoy, all of 1001 Spring St., Suite 724, Silver Spring, Md. 20910

[21] Appl. No.: 967,865

[22] Filed: Dec. 7, 1978

[51] Int. Cl.[1] ..... G08B 3/00

[52] U.S. Cl. ..... 340/384 E; 46/232

[58] Field of Search ..... 340/384 R; 46/232; 445/1

[56] References Cited

U.S. PATENT DOCUMENTS

| | | | |
|---|---|---|---|
| 2,603,912 | 7/1952 | Gruber | 46/118 |
| 3,162,980 | 12/1964 | Hellman | 46/232 |
| 3,199,248 | 8/1965 | Suzuki | 46/232 |
| 3,287,849 | 11/1966 | Weiss | 46/232 |
| 3,469,039 | 9/1969 | Lee | 179/100.2 |
| 3,568,336 | 3/1971 | Noble | 35/32 |
| 3,685,200 | 8/1972 | Noll | 46/232 |
| 3,912,694 | 10/1975 | Chiappe | 360/79 |
| 4,000,489 | 12/1976 | Bench | 340/384 R |
| 4,023,078 | 5/1977 | Olliges | 340/384 R |
| 4,065,767 | 12/1977 | Neuhof | 340/384 R |

*Primary Examiner*—Harold I. Pitts

*Attorney, Agent, or Firm*—Cushman, Darby & Cushman

[57] ABSTRACT

An electronic toy doll including electronic circuitry for selectively generating a number of simulation sounds typically associated with a mystic or science fantasy character. In respective operational modes, the sound of wind, the sound of breathing, an eerie pseudo-random sequence of musical notes and sounds representing the operation of a weapon are selectively generated. In a further operational mode, a random one of a predetermined number of responses are provided upon generation of an actuation signal. The random response may be considered to be an answer to inquiries. Preferred circuitry for generating the simulation sounds is described, accessories, adapted for removable interconnection with the circuitry are also described.

62 Claims, 7 Drawing Figures

P5
T1
P2
BREATH
WEAPON
ORACLE
CL17/.5KZ
GONG
ORACLE
546
550
528
548
CLK
Q
FF
558
D
Q
552
GONG
556
530
544
CRACKLER
554
CL17/.5HZ
CL18/.25HZ
BREATH
510
330 K
P1
9/6
518
WIND
CONTROL 116
GATING
334
C3
BR
520
522
526
WPN
DATA
C2
ORCL
524
532
536
512
BR
538
542
WPN
CONTROL
C4
ORCL
514
540
C1
CL19/.125HZ
559
150K
150K
.01
.01
560
568
562
570
572
MUSIC
T2
R5
150K
R10
47K
P4
564
P3
566
CL10/64HZ
WEAPON
P4
576
574
580
582
978
ACCESSORY
122 CONTROL
CL13/8HZ
LEDS
EYE L.E.D.S
584
24
26
100Ω
1K
ACCESSORY LED.
(FROM HAND)

MULTI-MODE DOLL

FIELD OF THE INVENTION

The present invention relates to toys, and in particular to an electronic doll.

DESCRIPTION OF THE PRIOR ART

Electronic dolls in general are well known. For example, dolls including electrical circuitry for generating simulation sounds are described in U.S. Pat. Nos. 3,912,694 (Chiappe et al, 1975), 3,199,248 (Suzuki, 1965), 3,685,200 (Noll, 1972), 3,287,849 (Weiss, 1966), 2,603,912 (Gruber, 1952), 3,568,336 (Noble, 1971), 3,162,980 (Hellman, 1964) and 3,469,039 (Lee, 1969).

Toys such as described in the above noted patents, however, typically utilize electromagnetic tape systems or other electromechanical mechanisms. Accordingly, the toys are not only relatively complex and expensive, but also relatively fragile.

In addition, mystic and science-fantasy characters are becoming increasingly popular among children. Accordingly, it is desirable to provide a toy which simulates sounds and actions typically associated with these type of characters.

SUMMARY OF THE INVENTION

The present invention provides a relatively inexpensive, rugged electronic doll. The doll selectively simulates the sounds typically associated with a mystic or science-fantasy character. The sounds of wind, breathing, weapons operation, and an eerie tune of pseudo-random musical notes are selectively produced. Additionally, the future is "foretold" through generation of a random one of a predetermined number of gong sounds generated in response to an actuation signal. The operational mode is controlled by a central function select logic circuit in cooperation with remote switches. The remote switches may be located in the doll body, or may be disposed in removably interconnectable remote accessories.

BRIEF DESCRIPTION OF THE DRAWING

A preferred exemplary embodiment of the present invention will hereinafter be described in conjunction with the following drawing wherein like numerals denote like elements and:

FIG. 1*a* is a block diagram of the electronic circuitry used in the toy;

DETAILED DESCRIPTION OF A PREFERRED EXEMPLARY EMBODIMENT

Figure 1:
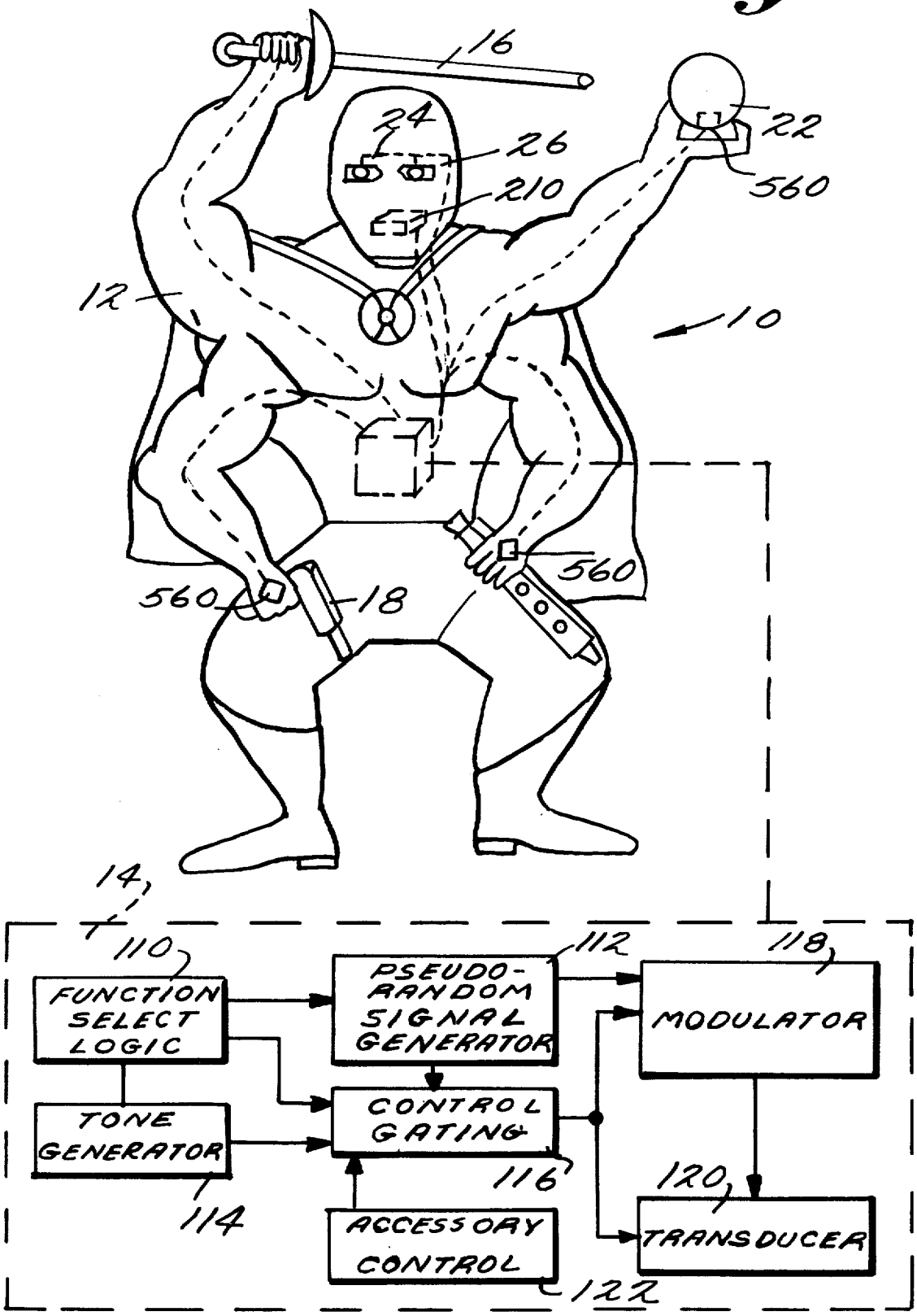
FIG. 1 is a pictorial illustration of an electronic doll in accordance with the present invention.

Referring now to FIGS. 1 and 1*a*, a toy doll 10 in accordance with the present invention includes a body 12. Body 12, as illustrated, is in the form of a four-armed alien warrior. The particular form of body 12 shown in FIG. 1 is for illustrative purposes only, and any form of body 12 may be utilized. For example, it may be particularly desirable that the body represent a robot like figure. Body 12 may be formed of any suitable materials, and suitably includes provisions for movement of the respective limbs.

Disposed within body 12 is electronic circuitry 14 for generating respective electrical simulation signals. Electronic circuitry 14 is shown in block diagram form in FIG. 1*a*. Function select logic 110 generates mode control signals representative of the desired operational mode of the toy. A pseudo-random signal generator 112 and tone generator 114 selectively provide respective signals in accordance with the mode control signals. The pseudo-random and tone signals are selectively applied through appropriate control gating logic 116 to a modulator 118 or directly to a transducer 120. Transducer 120 is suitably an amplifier and speaker, and converts the electrical signal into sound.

A number of accessories are provided. The accessories are associated with various of the operational modes. For example, a laser sword 16, a laser pistol 18, a musical instrument 20 and a crystal ball 22 are shown in FIG. 1. The accessories are adapted for removable mechanical coupling to body 12, removable electrical interconnection into circuitry 14, or both.

The respective accessories can be selectively interconnected into circuitry 14 to change the characteristics of or control the generation of the output signals through an accessory control circuit 122, as will be explained.

Figure 2:
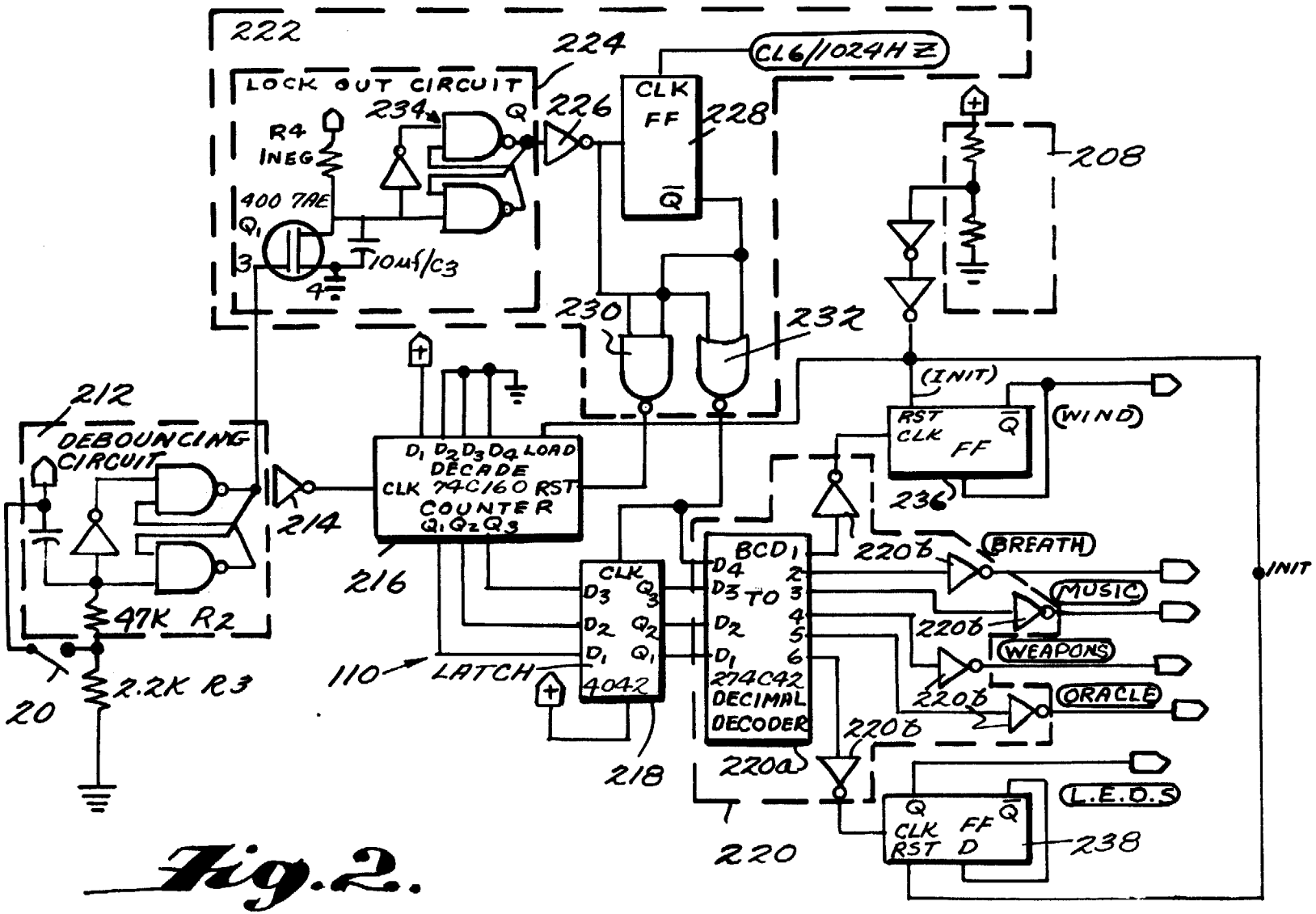
FIG. 2 is a schematic diagram of suitable function select logic.

Function select logic 110 may comprise any circuit capable of generating respective mode control signals corresponding to the operational modes of circuitry 14. For example, a plurality of switches coupled to a voltage source may be utilized. However, it is preferred that the operational mode be selected through operation of a single switch. The switch is closed (depressed a number of times corresponding to the desired operational mode. A preferred embodiment of function select logic 110 is shown in FIG. 2.

A momentary contact switch 210 is disposed in body 12. Switch 210 is coupled across suitable debouncing circuitry 212. Debouncing circuitry 212 generates a digital pulse, compatible with standard logic circuitry, each time switch 210 is depressed. Switch 210 is suitably disposed in the head of body 12. The head is pressed down or squeezed to depress switch 210.

The pulses from debouncing circuit 212 are applied through an inverter 214 to the clock input of a conventional decade counter 216. Decade counter 216 is suitably a presettable decade counter, such as a National Semiconductor MM74C610 decade counter with asynchronous clear. Decade counter 216 is suitably preset with a predetermined count during the initialization of the circuit. Counter 216 accumulates a count indicative of the number of times switch 210 is depressed. The contents of respective stages of counter 216 are applied as input signals to a conventional 3-latch register 218. Register 218 is suitably a National Semiconductor CD4042 quad clocked D latch.

The pulses from debouncing circuit 212 are also applied to a circuit 222 for resetting counter 216 in response to the first depression of switch 210 and for leading the contents of counter 216 into register 218 at the end of the selection process. Circuit 220 comprises a lockout circuit 224, coupled through an inverter 226 to the data (D) input of a D-type flip flop 228. A two input NAND gate 230 and a two input NOR gate 232 each have input terminals connected to the output of inverter 226 and to the $\overline{Q}$ output of flip flop 228. NAND gate 230 and NOR gate 232 are coupled to the reset terminal of counter 216 and to the clock terminal of register 218, respectively.

Lockout circuit 224 suitably comprises an NMOS FET Q1 (suitably a National Semiconductor CD4007), a capacitor C3 (10 μf), and an RS flip flop 234. Capacitor C3 is suitably coupled to a positive potential source through a resistor R4 (1MΩ), to the set (S) input of flip flop 234 and through an inverter to the reset (R) input terminal of flip flop 234. The conduction path of transistor Q1 is coupled across capacitor C3, to selectively short out the capacitor. The control electrode (gate) of transistor Q1 is responsive to the pulses from debouncing circuitry 212.

Lockout circuit 224 generates a low level signal in response to the first pulse produced by debouncing circuit 212. Capacitor C3 is initially charged through resistor R4. However, when the first pulse from debouncing circuit 212 renders transistor Q1 conductive, capacitor C3 is discharged. A low level signal is thus applied to the set input (S) and a high level signal to the reset (R) input of flip flop 234. The output of flip flop 234 therefore goes low.

The low level signal from lockout circuit 222 is applied through inverter 226 to the data input of D-type flip flop 228 and as input signals to NAND gate 230 and NOR gate 232. When flip flop 228 is clocked, the high level signal provided by inverter 226 is assumed by the flip flop. The $\overline{Q}$ output of flip flop 228 therefore goes low, and the output of NAND gate 230 is forced high. The positive going transition is the output of NAND gate 230 which resets counter 216.

So long as the time interval between pulses from debouncing circuit 212 does not exceed the charging time constant of capacitor C3, the output of flip flop 234 remains low. However, when the selection process is finished, i.e., switch 210 has been depressed a predetermined number of times corresponding to the desired operational mode, capacitor C3 is allowed to recharge. When the voltage across capacitor C3 reaches the logic high level, flip flop 234 is set. A low level signal is thus applied by inverter 226 to the D input of flip flop 228. When flip flop 228 is next clocked, its $\overline{Q}$ output goes high. The high level $\overline{Q}$ signal forces the output of NOR gate 232 to go low. The negative going transition in the output of NOR gate 232 causes latch register 218 to be loaded with the contents of decade counter 216.

The contents of register 218 are thus a binary coded decimal representation of the number of times switch 210 was depressed during a given mode selection sequence, corresponding to a desired operational mode. The contents of register 218 will hereinafter be referred to as a function select entry.

The outputs of register 218 are applied to a conventional BCD-to-decimal decoder 220. Decoder 220 is suitably comprised of a National Semiconductor MM74C42 BCD-to-decimal decoder chip **220*a* cooperating with a plurality of inverters 220*b*. BCD-to-decimal decoder chip 220*a* generates a low level signal at the output corresponding to the binary input from register 218 and a high level signal at each of the other output lines. The respective output signals of BCD-to-decimal decoder chip 220** are inverted and utilized to derive the respective mode control signals.

Flip flop 228 is suitably clocked by a 1024 Hz signal. The 1024 Hz clock signal and the various other signals of predetermined frequency are provided by a conventional timing circuit 600 shown in FIG. 6. An oscillator 602 produces a 64 KHz output signal. The 64 KHz signal is applied as a clock signal to a countdown chain 604 which produces respective signals at frequencies one octave apart, ranging from 32 KHz ($CL_1$) to 0.125 Hz ($CL_{19}$).

In the preferred embodiment, the line 1 of BCD-to-decimal decoder 220 is associated with a wind simulation mode; line 2, a breath mode control signal; line 3, a music mode control signal; line 4, a weapons mode control signal; line 5, an oracle mode control signal; and line 6, a control signal for activating respective LED's disposed on body 12 and the respective accessories.

The signals on the output lines of decoder 220 may be directly used as respective mode control signals. However, in some instances it is desirable that an operational mode be controlled in a toggle fashion so that concurrent operation in more than one mode is possible. The mode would be entered upon a function select entry corresponding to the mode, then terminated upon the next entry of that number. Toggle control is accomplished through the use of a D-type flip flop connected in toggle mode (i.e., $\overline{Q}$ output coupled to data input) and clocked by a respective decoder output line. For example, the wind simulation and LED modes are preferably controlled in this manner.

In the preferred embodiment, it is desired that a wind simulation mode be initiated upon start up of the system. When power is initially turned on, an RC timing network 208 is utilized to generate an initialization signal (INIT). The initialization signal, in effect, initializes the circuit as will be explained. The initialization signal from circuit 208 is applied to the reset terminal of a D-type flip flop 236. Flip flop 236 is connected in a toggle mode, with the $\overline{Q}$ output tied back to the data input of the flip flop. The wind control signal is derived from the $\overline{Q}$ output of flip flop 236. The signal from the BCD-to-decimal decoder line 1 is applied to the clock input of flip flop 236, the system is initially turned on, flip flop 236 is reset by the INIT signal and the wind mode control signal generated. When a zero level signal is subsequently generated at line 1 of decoder 220, the signal clocks flip flop 236. The $\overline{Q}$ output of flip flop 236 thus assumes a low level, and the wind mode operation terminated.

Similarly, a D-type flip flop 238 interconnected in a toggle mode cooperates with decoder 220 to generate the LED control signal. Flip flop 238 is initially reset by the initialization signal (INIT). The Q output of flip flop 238 provides the LED control signal. A low level LED control mode signal enables the LED's as will be explained. When line 6 of decoder 220 is thereafter activated, flip flop 238 is clocked, providing a high level Q output to turn off the LED's. The LED control signal will remain at a high level until flip flop 238 is again clocked by the next activation of decoder 220, line 6.

A connection between the output of NOR gate 232 and the D4 input of terminal of decoder 220 is provided to facilitate the toggle function of the flip flops 236 and 238. In effect, the low level transition of NOR gate 232 places decoder 220 in an illegal state. The intervening illegal state causes, successive input sequences of the same value to be registered separately by decoder 220. Separate signals are therefore provided to toggle flip flops 236 and 238 where appropriate.

The wind simulation signal is generated by pseudo-random signal generator 26 and applied through control gating 30 to transducer 34.

Figure 3:
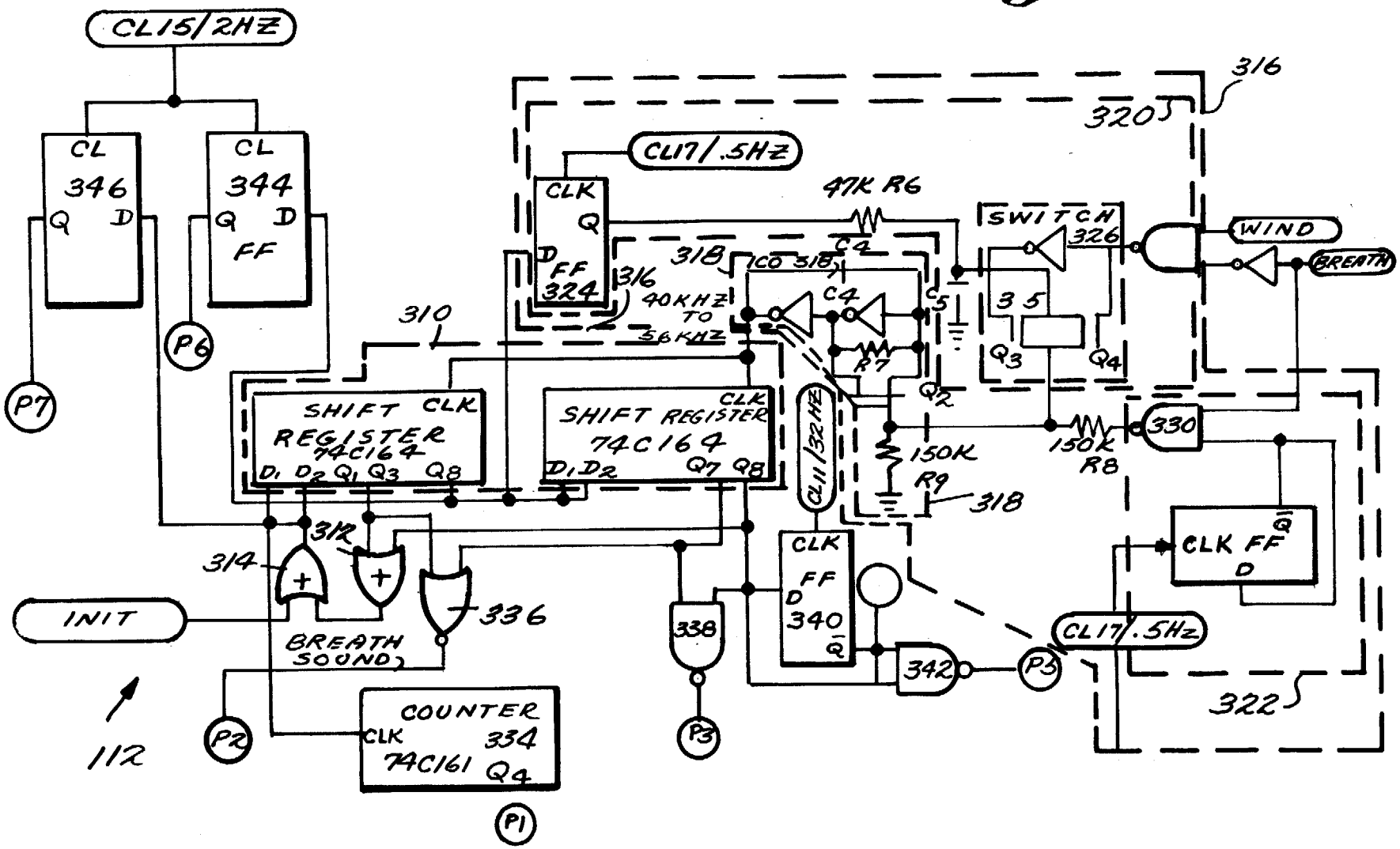
FIG. 3 is a schematic diagram of a suitable pseudo-random signal generator.

A suitable pseudo-random signal generator 112 is shown in FIG. 3. The basic pseudo-random signal generator comprises a shift register 310 and a two input exclusive OR (EXOR) gate 312. Shift register 310 is suitably formed of a two serially connected National Semiconductor 74C164 8-bit parallel out shift registers. Shift register 310 includes a data input terminal, a clock input terminal and respective output terminals corresponding to each of the respective stages of the shift register. In response to each signal applied to the clock input terminal, the successive stages of the shift registers are loaded with the contents of the just previous stage. The first stage of the shift register is loaded with the signal applied to the data input terminal. The input terminals of EXOR 312 are connected to respective output terminals of shift register 310. In the preferred embodiment, EXOR 312 is coupled to the third and last stages of shift register 310. The output signals of EXOR 312 are applied as data signals to shift register 310. A further exclusive OR gate 314 may be interjected between EXOR 312 and the data input of shift register 310. One input of EXOR 314 is receptive of the output signal of EXOR 312. The other input terminal of EXOR 314 is receptive of the initialization signal (INIT). EXOR 314 ensures that a high level value is initially loaded into shift register 310 to preclude the possibility of stalling.

Shift register 310 changes state in response to signals applied to its clock input. The clock signals are generated by a clock signal generator circuit 316. As will be explained, the clock signals have a frequency characteristic in accordance with the particular operational mode of circuit 14. Clock signal generator 316 includes a conventional controlled oscillator (VCO) 318, an irregular waveform signal generator 320, and a bilevel signal generator 322. Irregular waveform generator 320 and bilevel signal generator 322 selectively provide control signals to VCO 318. Clock signal generator 316 is responsive to the wind mode and breath mode control signals from function select logic 24.

Irregular waveform generator 320 is enabled by the wind mode control signal and generates a control signal to VCO 318 during wind mode operation. The control signal is, in effect, an analog signal which increases and decreases in magnitude in a pseudo-random fashion. Irregular waveform signal generator 320 comprises a D-type flip flop 324, a resistor R6 (47K), a capacitor C5 (100 $\mu$f), an analog switch 326 and a 2-input NAND gate 328. Capacitor C5 and resistor R6 are coupled in series between the Q output of flip flop 324 and ground. The D input of flip flop 324 is coupled to one of the output terminals of shift register 310. Accordingly, a pseudo-random value is applied at the data input of flip flop 324. Flip flop 324 is clocked at a predetermined rate 0.5 Hz ($CL_{17}$). Capacitor C5 is pseudo-randomly charged and discharged in accordance with the content of flip flop 324 to generate an analog signal of pseudo-random amplitude.

NAND gate 328 is responsive to the wind mode control signal and, through an inverter, to the breath mode control signal. When the wind mode control signal is high and the breath mode control signal is low, NAND gate 326 receives two high level inputs and generates a low level input to render switch 326 conductive. Switch 326 suitably comprises a complimentary MOS switch and selectively provides a conduction path to connect VCO 318 across capacitor C5. Thus, during wind mode operation, the irregular voltage across capacitor C5 is utilized as the control voltage for VCO 318. Accordingly, during the wind mode operation the contents of shift register 310 change at pseudo-random rates.

Bilevel signal generator 322 provides during breath mode operation, a clock signal to shift register 310 which alternates between respective high and low frequency signals at a predetermined rate. Bilevel signal generator 322 comprises a two input NAND gate 330 and a D-type flip flop 332. Flip flop 332 is connected in a toggle mode, (with data input coupled to $\overline{Q}$ output) and is clocked at a predetermined frequency (e.g., 0.5 Hz ($CL_{17}$). The input terminals of NAND gate 332 are coupled to the $\overline{Q}$ output of flip flop 332 and to the breath mode control line, respectively. The output of NAND gate 330 is coupled through a resistor R8 (150K$\Omega$) to the control input of VCO 318.

During the breath mode, the inverted high level breath mode control signal forces the output of NAND gate 328 to go high. Switch 326 is rendered non-conductive, isolating VCO 318 from the pseudo-random voltage produced across capacitor C5. The breath mode control signal, however, enables NAND gate 330. The toggled output of flip flop 332 is therefore applied as the control signal to VCO 218. Thus, during breath mode operation, the irregular signal generator 320 is, in effect, inhibited and VCO 318 is controlled by a bilevel signal, alternating between logic high and logic low levels at a predetermined rate. During operational modes where neither breath nor wind mode control signals are high level, both NAND gates 328 and 330 are forced high (inhibited) and VCO 318 generates a constant frequency output signal.

Various pseudo-random signals are derived from the output signal of shift register 310 and provided at respective output terminals P1-P7. As will hereinafter be more fully explained, the pseudo-random signal produced at output terminal P1 are utilized in generating the wind simulation signal; at output terminal P2, the breath simulation signal; at output terminals P3 and P4, the weapons sound simulation; at output terminal P5, the oracle sounds; and at output terminals P6 and P7, pseudo-random musical notes.

The output of exclusive OR gate 314 is applied as a clock input to a conventional binary counter 334. Binary counter 334 is suitably a National Semiconductor MM74C161 binary counter with asynchronous clear. Counter 334 operates as a frequency divider ($\div 16$) and, in effect, interjects a harmonic quality into the pseudo-random signal. The output of counter 334 is provided at pseudo-random generator output terminal P1 for use in generating the wind simulation signal.

The pseudo-random signal at P3 is generated by a conventional two input NOR gate 336. The input terminals of NOR gate 336 are coupled to respective output terminals of shift register 310. The respective input signals to NOR gate 336 are thus identical but delayed from one another by an amount determined by the clock frequency and the number of intervening stages in shift register 310. In the preferred embodiment, the input terminals of NOR gate 336 are coupled to the third and next to last stages of shift register 310. The output of NOR gate 336 is provided at output terminal P2 for use in generating the breath simulation signal. The signal at P3 is generated by a two output NAND gate 338. The input terminals of NAND gate 338 are coupled to respective output terminals (e.g., next to the last and last) of shift register 310. The output of NAND gate 338 is provided at output terminal P3. The pseudo-random signal provided at output terminal P4 is generated by a D-type flip flop 340. Flip flop 340 is clocked by a signal of predetermined frequency (e.g., 32 Hz, $CL_{11}$). The data input is coupled to one output terminal (e.g., the last) of shift register 310. The $\overline{Q}$ output terminal of flip flop 340 is the P4 output terminal of pseudo-random signal generator 112. The signal at P4 is also utilized in the activation of respective LED's disposed on body 12 and various accessories. The pseudo-random signal provided at terminal P5 is generated by a two input NAND gate 342. NAND gate 342 is responsive to one (e.g., ' the last) output terminal of shift register 310 and the $\overline{Q}$ output of flip flop 340. The output of NAND gate 342 is provided at terminal P5. Similarly, the pseudo-random signals provided at output terminals P6 and P7 are generated by respective D-type flip flops 344 and 346. Flip flops 344 and 346 are both clocked by a predetermined frequency signal (e.g., 2 Hz, $CL_{15}$). The data inputs of flip flops 344 and 346 are coupled to respective output terminals of shift register 310 (e.g., the eighth and last, respectively). The pseudo-random signals are provided at the Q outputs of the flip flops.

Referring now to FIG. 11, tone generator 114 generates one of a plurality of tone signals in accordance with the particular operational mode of circuitry 14. Tone generator 114 includes first and second frequency gates 410 and 412, a controllable frequency divider 425 and an exclusive OR gate 446.

Frequency gates 410 and 412 provide output signals of particular frequencies in accordance with the operational mode of circuit 14. Frequency gate 410 comprises respective conventional two input NAND gates 414, 416 and 418, respectively. The outputs of each of NAND gates 414, 416 and 418 are applied to the respective inputs of a three input NAND gate 420. One input of NAND gates 414, 416 and 418 are responsive to the weapons mode, oracle mode, and musical mode control signals, respectively. The second input terminals of NAND gates 414 and 416 are responsive to a 4906 Hz ($CL_4$) signal from timing network 600. The second input of NAND gate 418 is receptive of the 64 KHz signal from oscillator 602 of timing circuit 600. Frequency gate 410 thus passes the 4906 Hz signal during weapons mode or oracle mode operation, passes the 64 KHz signal during music mode operation and is inhibited during the other operational modes.

Similarly, frequency gate 412 comprises three two-input NAND gates 420, 422 and 424. The first inputs of NAND gates 420 and 422 are responsive to the oracle and weapons mode control signals, respectively. The second inputs of NAND gates 420 and 422 are receptive of a 256 Hz ($CL_8$) and 64 Hz ($CL_{10}$) signal, respectively. The output terminals of NAND gates 420 and 422 are coupled to the respective inputs of NAND gate 424. Accordingly, frequency gate 412 produces an output signal having a frequency of 64 Hz during weapons mode operation, a frequency of 256 Hz during oracle mode operation, and no output during the other operational modes.

The output signal of frequency gate 410 is applied to controllable frequency divider 425. Frequency divider 425 produces an output signal having a frequency equal to the output signal of frequency gate 410 divided by a predetermined number in accordance with the operational mode of circuit 14. The output signal of gate device 410 is applied as a clock signal to conventional binary counter/divider 426. Counter 426 is suitably a National Semiconductor CD4040. The respective outputs of counter 426 are applied to respective logic circuits (decoders) 428, 430 and 432. Logic decoders 428, 430 and 432 are associated with the weapons, oracle and music operational modes, respectively.

Decoder 428 comprises a conventional 5-input NAND gate 434. The respective input terminals of NAND gate 434 are connected to respective output terminals of binary counter 426 (Q2, Q3, Q4, Q5 and Q6). NAND gate 434 therefore generates a low level output signal only upon binary counter 434 attaining a 0, 1, 1, 1, 1, 1 count (decimal 62).

Similarly, decoder 430 comprises a 2-input NAND gate 436. The input terminals of NAND gate 436 are coupled to the Q3 and Q4 output terminals of counter 426. Thus, NAND gate 436 generates a decimal low level signal when counter 426 accumulates a count equivalent to decimal 12.

Decoder logic 432 comprises respective NOR gates 438, 440 and 442 coupled through respective inverters 444, 446 and 448 to a conventional 5-input NAND gate 450. The other two input terminals of NAND gate 450 are directly coupled to the Q4 and Q6 output terminals of counter 426. The input terminals of NOR gates 438, 440 and 442 selectively couple the odd stages of counter 426 to the inputs of NAND gate 450. The first input terminals of NAND gates 438, 440 and 442 are coupled to the Q5, Q3 and Q1 outputs of counter 426, respectively. The second input terminal of NAND gates 438 and 440 are receptive of pseudo-random signals from pseudo-random generator 112, terminals P6 and P7, respectively, as will be explained. The other input terminal of NOR gate 442 receives a 4 Hz ($CL_{14}$) signal from timing circuit 55. Thus, decoder logic 432 generates a low level signal in response to a pseudo-random one of a plurality of respective counts (e.g., 40, 41, 44, 45, 56, 57, 60, 61). The 4 Hz ($CL_{14}$) input provides a tremelo effect.

The output decoders 428, 430 and 432 are applied to another selective gating device 452. Selective gating device 452 selectively passes the signals from the particular decoder associated with the instantaneous operational mode of circuitry 14. Selective gating device 452 comprises respective 2-input NAND gates 454, 456 and 458 and a 3-input NAND gate 460. The output terminals of NAND gates 454, 456 and 458 are coupled to the input terminals of NAND gate 460. The first input terminals of NAND gates 454, 456 and 458 are receptive of the output signals of decoders 428, 430 and 432. The second input terminals of NAND gates 454, 456 and 458 receive the weapons mode control signal, oracle mode control signal and music mode control signal, respectively. Thus, gate 452 selectively passes output signals of the decoder associated with the weapons, oracle and music modes and is otherwise inhibited.

The output of selective gate 452 is applied to the data input of a D flip flop 462. Flip flop 462 is clocked by the output signal of frequency gate 410. The $\overline{Q}$ output of flip flop 462 is applied to the reset terminal of counter 426. The $\overline{Q}$ output of flip flop 462 is also utilized as a clock input to a second D-type flip flop 464. Flip flop 464 is coupled in a toggle mode (data input coupled to $\overline{Q}$ output).

Counter 426, decodes 428, 430 and 432, gate device 542 and flip flops 462 and 464 together operate as variable divider 425. Counter 426 accumulates a count in accordance with the frequency of the output signal of frequency gate 410. Decoders 428, 430 and 432 generate respective output signals when particular counts are attained in counter 426. Gate 452 selects and passes the output signals of the decoder associated with the instantaneous mode of circuit 14 to flip flop 462. Flip flop 462 resets counter 426 and clocks flip flop 464. The output of flip flop 464 is thus a squarewave having a frequency equal to the output frequency of gate 410 divided by the particular count required to enable the selected decoder.

The output of flip flop 464 is, in effect, mixed with the output signal of frequency gate 412 by exclusive OR gate 466 and the mixed signal provided at a tone generator output terminal T1. The output signal of flip flop 464 is also provided at a tone generator output terminal T2.

Figure 5:
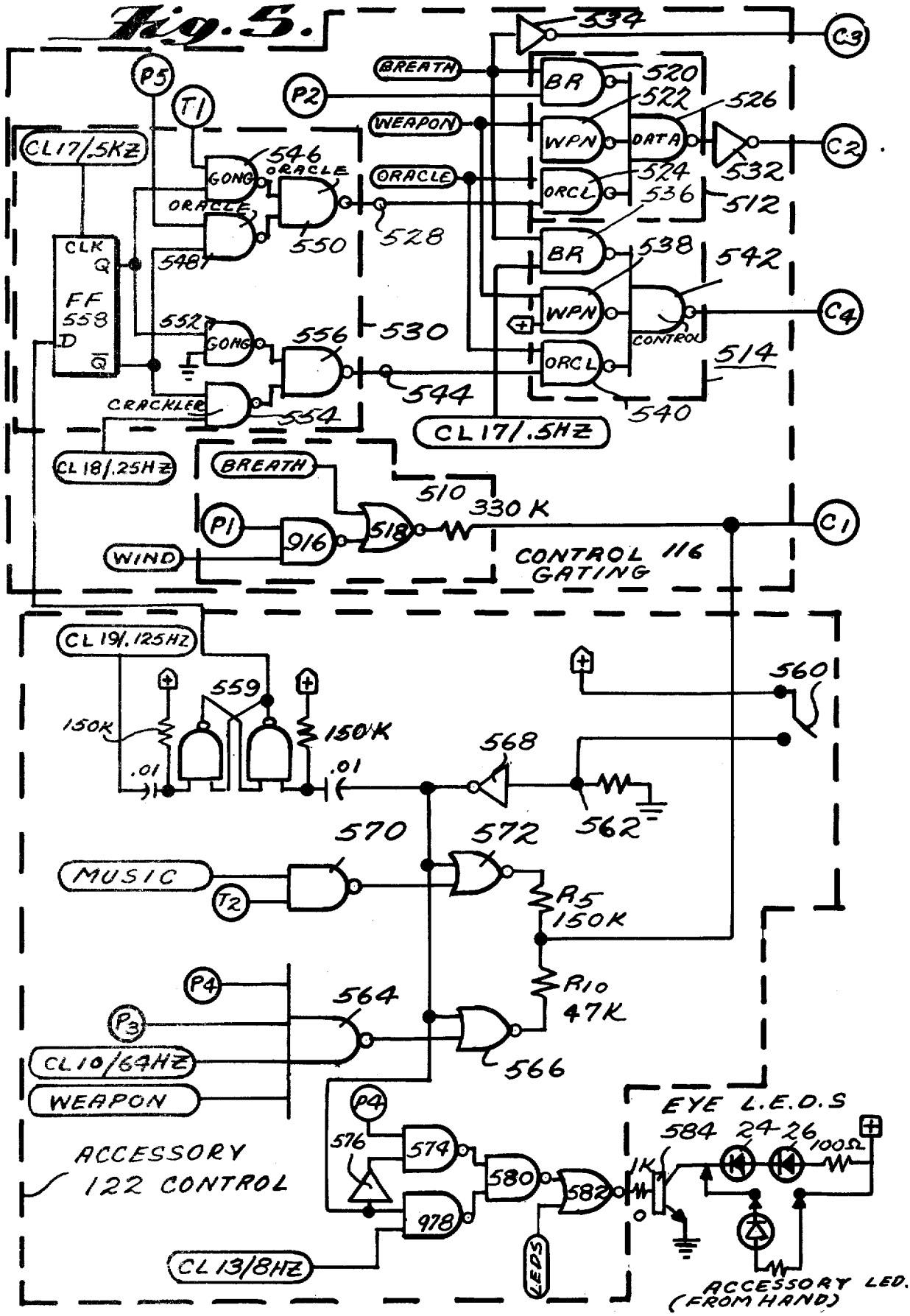
FIG. 5 is a schematic diagram of a suitable modulator and transducer.

Referring now to FIG. 5, control gating 116 comprises respective selective gating logic circuits 510, 512 and 514. Control gating 116 selectively applies signals to modulator 118 and transducer 120 to effect generation of the respective simulation signals.

Gating logic 510 comprises a 2-input NAND gate 516 and a 2-input NOR gate 518. NAND gate 516 is responsive to the wind mode control signal from function select logic 110 and to a pseudo-random signal from pseudo-random generator output terminal P1. The output signals of NAND gate 516 are applied to one input terminal of NOR gate 518. NOR gate 518 is also responsive to the breath mode control signal from function select logic 110. The output of NOR gate 518 is applied through a loading resistor (330K) to control gating output terminal C1. Output terminal C1 is connected to the input terminal of transducer 120. As will be explained, logic 510 selectively applies the pseudo-random signal at P3 to transducer 120 to effect generation of wind simulation sounds.

Gating logic 512, hereinafter referred to as data gate 512, selectively provides a data signal in accordance with the operational mode of circuit 14 at an control gating output terminal C2 for application to modulator 118. Data gate 512 suitably comprises three 2-input NAND gates 520, 522 and 524 and a 3-input NAND gate 526. The first input terminals of 2-input NAND gates 520, 522 and 524 are receptive of the breath, weapons and oracle mode control signals from function select logic 110. The second terminal of NAND gates 520, 522 and 524 are connected to the P2 output terminal of psuedo-random generator 112, the T1 output terminal of tone generator 114 and to a first output terminal 528 of a logic circuit 530 (associated with oracle mode operation, as will be explained), respectively. The output terminals of NAND gates 520, 522 and 524 are coupled to the input terminals of 3-input NAND gate 526. The output signals from NAND gate 526 are applied through an inverter 532 to control gating output terminal C2. The breath mode control signal is also applied, through an inverter 534, to provide an inverted breath mode control signal at control gating output terminal C3 for application as a control signal to modulator 118, as will be explained.

Gating logic 514, hereinafter referred to as control signal gate 514, selectively provides a control signal in accordance with the operational mode of circuit 14 at a control gating output terminal C4 for application to modulator 118. Control signal gate 514 comprises, like data gate 512, three 2-input NAND gates 536, 538 and 540 and a 3-input NAND gate 542. The first input terminal of 2-input NAND gates 536, 538 and 540 are receptive of the breath, weapons and oracle mode controls, respectively. The second inputs of NAND gates 536, 538 and 540 are receptive of a predetermined frequency signal (0.5 Hz, $CL_{17}$), a high level signal, and a signal provided at mode 544 from logic circuit 530. The output signals of NAND gates 536, 538 and 540 are applied as input signals to 3-input NAND gate 542. The output signals of NAND gate 542 are provided at control gating output terminal C4.

Logic circuit 530 is associated with oracle mode operation and controllably provides one of two data signals at terminal 528 and one of two control signals at terminal 536. Logic circuit 530 comprises first and second sets of three 2-input NAND gates 546, 548 and 550 and 552, 554 and 556, respectively, and a D-type flip flop 558. The first input terminals of NAND gates 546, 548, 552 and 554 are coupled to tone generator output terminal T1, pseudo-random signal generator output terminal P1, ground potential and to output $CL_{18}$ (0.25 Hz) of timing circuit 600. The other input terminals of NAND gates 546 and 552 are coupled to the Q output of flip flop 558. The other input terminal of NAND gates 548 and 554 are coupled to the $\overline{Q}$ output of flip flop 558. Flip flop 558 is clocked by a 0.5 Hz signal ($\overline{CL}_{17}$). The data input is coupled to the Q output terminal of an RS flip flop 560 in accessory control circuit 122, as will be explained. Thus, when flip flop 558 is set, tone generator output terminal T1 is, in effect, coupled to data gate 512 and a low level signal coupled to control gate 514. When flip flop 558 is reset, pseudo-random generator output terminal P5 is coupled to data gate 512 and a 0.25 Hz signal applied to control gate 514.

Figure 6:
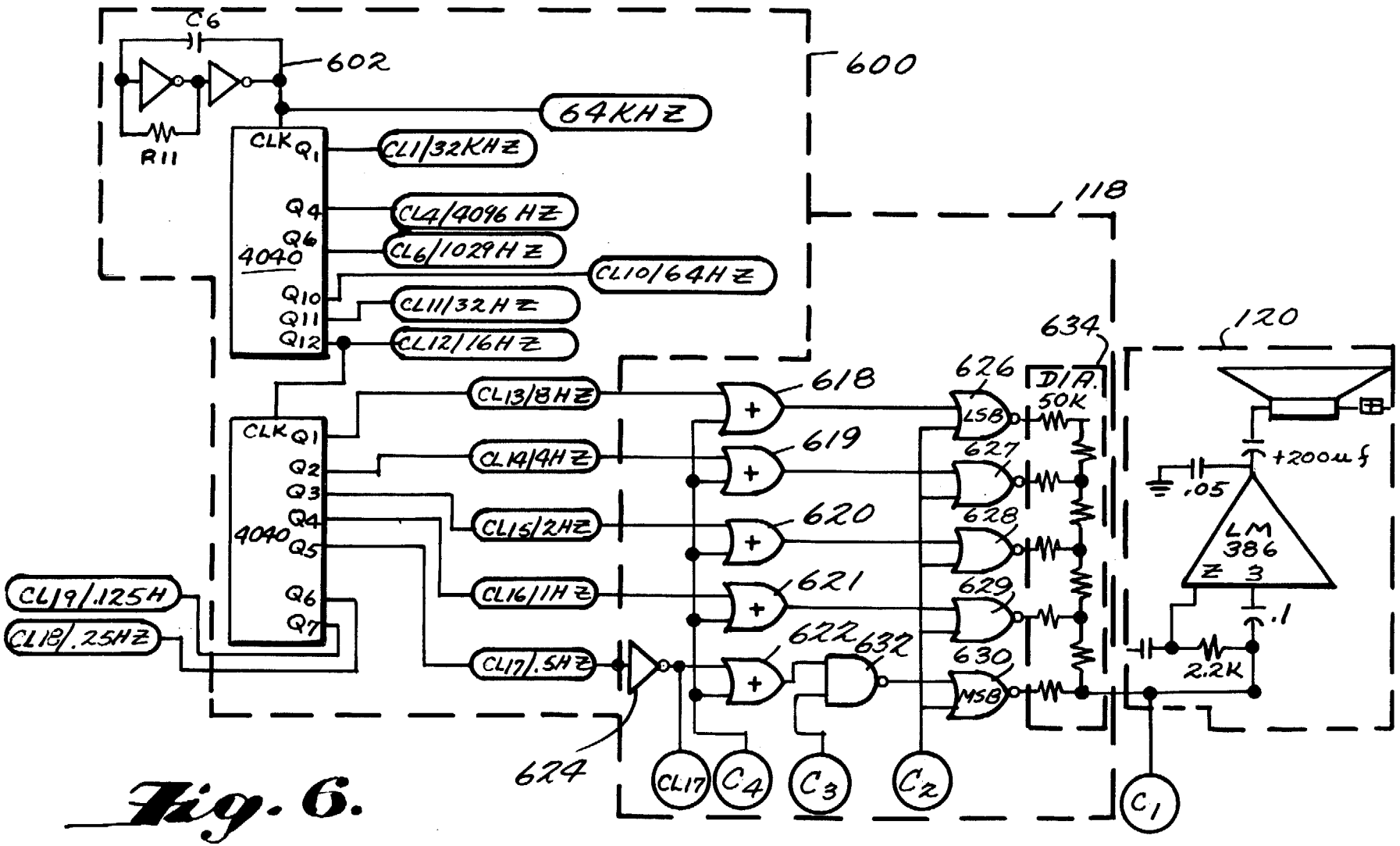
FIG. 6 is a schematic diagram of a suitable control gating logic.

Modulator 118 amplitude modulates the data signal from control gating 116 with a waveform in accordance with the control signal provided at control gating terminal C4. Referring now to FIG. 6, one input of each of a bank of exclusive OR gates 618-622 is coupled to control gating terminal C4. The other input terminals of EXOR gates 618-622 are responsive to respective signals of differing predetermined frequencies, suitably ranging from 8 Hz, ($CL_{13}$) to 0.5 Hz ($CL_{17}$) in octave intervals. The predetermined frequency signal (0.5 Hz) to EXOR gate 622 is suitably inverted by an inverter 624. The output terminals of EXOR gates 618-621 are coupled to one input terminal of respective NOR gates 126-129 of a bank of NOR gates 126-130. The output terminal of exclusive OR gate 622 is coupled to one input of a 2-input NAND gate 632. The other input of NAND gate 632 is responsive to the inverted breath mode control signal provided at terminal C3 of control gating 116. The output terminal of NAND gate 632 is coupled to one input of NOR gate 630. The other input terminals of NOR gates 626-630 are each connected to control gating terminal C2.

The output terminals of NOR gates 626-630 are coupled to the input terminals of a conventional D/A converter 634. D/A converter 634 suitably comprises a resistive ladder network. NOR gate 626 is suitably coupled to the least significant bit input and NOR gate 630 coupled to the most significant bit input of D/A converter 634.

When power is first applied to circuit 14, wind mode operation is inhibited. Referring to FIG. 2, flip flop 236 in function select logic 110 is reset by the initialization signal (INIT) to generate a high level wind mode signal at the $\overline{Q}$ output thereof. Wind mode operation is maintained until flip flop 236 is toggled by a subsequent entry of one through switch 210. The initialization signal also preloads counter 216 with a 1 count so that the first entry of one after initialization does not terminate the wind mode operation.

The high level wind mode control signal activates irregular signal generator 320 (FIG. 3) in pseudo-random signal generator 112. Shift register 310 thus changes state at a pseudo-random rate.

The high level wind mode control signal also enables NAND gate 516 (FIG. 5) in control gating 116. During wind mode operation the breath mode control signal is low. Accordingly, NOR gate 518 is enabled and pseudo-random signal generator output terminal P1 is, in effect, coupled to transducer 120. Transducer 120 generates a sound simulating the blowing of wind.

When switch 38 is depressed twice, a high level breath mode control signal is generated to initiate breath mode operation. The pseudo-random signal, produced at pseudo-random generator 112 is applied through control gating 116 to modulator 118. Modulator 118 under the control of control gating 116, in effect, generates an analog signal indicative of the pseudo-random signal modulated with a signal that alternately progressively increases then progressively decreases in amplitude. A high level breath mode control inhibits irregular waveform generator 320 (FIG. 5) of pseudo-random generator 112 and, enables bilevel signal generator 322. Accordingly, the clock frequency to shift register 310 alternates between high and low predetermined frequencies.

Pseudo-random signal generator output terminal P2 is coupled to one input terminal of one 2-input NAND gate 520 (FIG. 5) of data gate 512. NAND gate 520 is enabled by the breath mode control signal. NAND gates 522 and 524 (respectively responsive to the weapon and oracle mode control signals) are inhibited (outputs forced high) during breath mode operation. NAND gate 520 therefore generates an inverted signal indicative of the output signal of the pseudo-random signal provided at pseudo-random signal generator output terminal P2. The output signal of NAND gate 520 is reinverted and passed by NAND gate 526. The output signal of NAND gate 526 is inverted and applied to modulator 118 as a data input signal.

Similarly, the breath mode control signal is applied to enable NAND gate 536 to control signal gate 514. Thus, a 0.5 Hz ($CL_{17}$) signal is provided at control gating output terminal C4 for application as a control signal to modulator 112 to control the modulation waveform.

In response to the 0.5 Hz input signal, EXOR gates 618-621 alternately pass or invert the respective differing predetermined frequency signals at a 0.5 Hz rate. This effects an alternating attack (progressive increase) and release (progressive decrease) of the magnitude of the analog signal produced by D/A converter 634. Thus, the breath simulation signal is a pseudo-random signal having an amplitude envelope which alternately progressively increases and progressively decreases. The analog signal from D/A converter 634 is applied to the input of transducer 120, to effect an audible simulation of breathing. During breath mode operation, the output signal of NAND gate 630 of modulator 118 is forced high by the low level inverted breath mode control signal produced at control gating terminal C3. Accordingly, the output of NOR gate 630 is forced low, and the most significant bit of D/A converter is maintained at zero, providing a relatively low level of sound as compared to that provided in the other operational modes.

The weapons mode operation of circuitry 14, in itself, includes two separate operational modes. In one mode, a tone output from tone generator 114 is applied by control gating 116 to modulator 120. Control signals are generated to modulator 118 to, in effect, modulate the tone with a sawtooth waveform. In a second mode, instituted in response to accessory control circuitry 122, a pseudo-random signal is superimposed on the modulated signal. The weapons mode operation is associated with accessories 16 and 18. For example, in the sound produced in the first instance can represent the sound of laser sword 16, while the accessory control mode can represent the firing of laser pistol accessory 18.

A high level weapons mode signal is generated when a function select sequence of four (4) is entered through switch 210.

Figure 4:
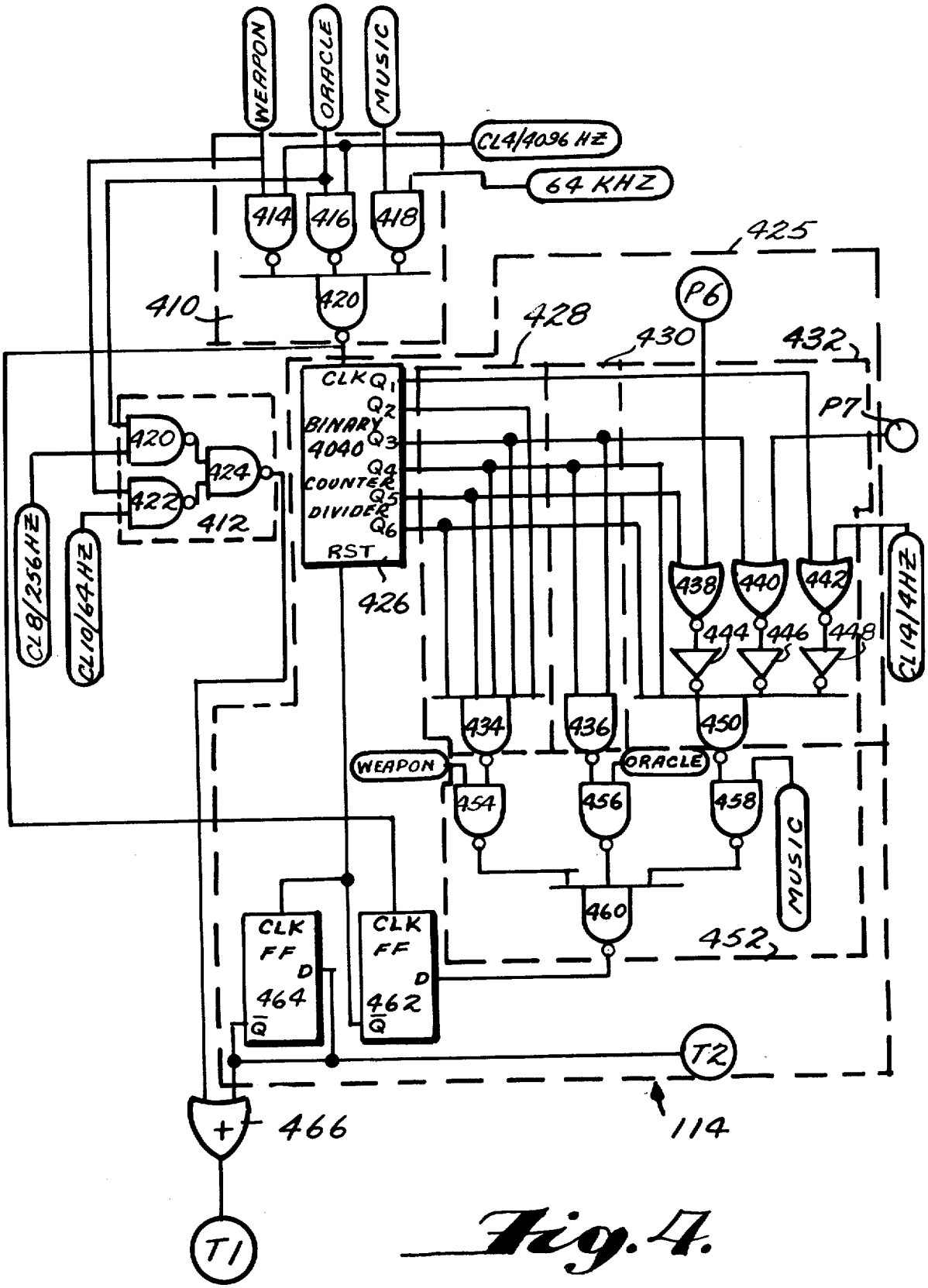
FIG. 4 is a schematic block diagram of a suitable tone generator.

Tone generator 114 generates multi-tone signals having 64 Hz and 66 Hz by components at output terminal T1. Referring to FIG. 4, during weapons mode operation, frequency gate 410 passes a 4096 Hz ($CL_4$) signal. NAND gate 454 is enabled by the weapons mode control signal. Selective gate 162 therefore passes the output of decoder 156. The output signal of flip flop 464 is thus a square-wave at approximately 66 Hz. Frequency gate 412 provides a 64 Hz output signal. Exclusive OR gate 466, in effect, mixes the 64 Hz and 66 Hz signals. Thus, a multi-toned signal comprising two notes slightly out of tune is provided at tone generator output T1.

The signals produced at tone generator output terminal T1 are applied by control gating 116 as a data signal to modulator 118. Referring to FIG. 5, tone generator output terminal T1 is coupled to one input terminal of NAND gate 522 in data gate 104. The other input terminal of NAND gate 522 receives the weapons mode control signal. Thus, data gate 512 produces an inverted signal representative of the multi-tone signal provided by exclusive OR gate 566 at control gating output terminal C2. The inverted tone signal is applied as a data signal to NOR gates 126–130 of modulator 118.

The weapons mode control signal is also applied as an input of NAND gate 538 of control signal gate 514. The other input terminal of NAND gate 538 is tied to a positive source. Thus, a high level signal is generated at control gating output C4, for application to one input terminal of exclusive OR gates 618-622 in modulator 118. Exclusive OR gates 618-622 thus operate as inverters. Accordingly, the amplitude of the signal generated by D/A converter 634 progressively increases during each counting cycle of the countdown chain 604 of timing circuit 600 (0.25 Hz). Modulator 118 thus, in effect, amplitude modulates the tone signal from tone generator 114 with a sawtooth waveform. The modulated signal is applied to transducer 120 to produce the weapons sound simulation. It should be noted that NAND gate 132 is enabled by the high level inverted breathing mode control signal generated at terminal C3. Accordingly, the most significant bit is operative during the weapons sound generation.

A second sound effect is selectively provided to simulate the firing of a laser pistol or the like. Referring to FIG. 5, a laser pistol sound is generated in response to activation of an accessory signal switch 560. Switch 560 may be located in body 10, for example in a hand, or may be included in an accessory. Where switch 560 is in the accessory, the accessory would be removably interconnected into circuitry 14 by standard plug and socket techniques. If desired, only a single hand can be adapted to receive the accessories.

A single switch 560 is shown in FIG. 5. However, it should be appreciated that a plurality of such switches may be utilized. A socket may be provided in each hand of body 12, into which an accessory may be plugged. The accessory would include a switch to selectively complete a connection between the positive voltage source and mode 562 in accessory control circuit 122 (FIG. 5).

Similarly, LED's may be provided in the accessory for removable interconnection into circuitry 14. For example, laser pistol 18 may include both a switch 560 and an LED having an associated driving transistor coupled to the current path provided by closing switch 560. The LED's would illuminate during periods when switch 560 is closed. Alternatively, the driving circuitry for eye LED's (located in body 12, as will be explained) may be utilized. The LED's in the accessory would be coupled to the driver circuit through a separate plug-socket interconnection.

Also, if desired, the respective hands can be adapted to receive only a particular accessory, and separate conductive lines provided to the respective associated circuitry in accessory control circuit 122.

With respect to laser piston 18, switch 560 is suitably a momentary contact switch. Switch 560 is suitably closed by touching (squeezing) accessory pistol 18 or the hand of body 12. When switch 560 is closed during weapons mode operation, a pseudo-random signal is superimposed on the modulated tone signal applied to transducer 120.

Referring now to FIG. 5, a conventional 4-input NAND gate 564 in accessory control circuit 122 receives respective pseudo-random signals from terminals P3 and P4 of pseudo-random signal generator 112, a 64 Hz ($CL_{10}$) signal and the weapons mode control signal. The output terminal of NAND gate 564 is coupled to one input of a 2-input NOR gate 566. The other input of NOR gate 566 is coupled to switch 560 through an inverter 568. Thus, NOR gate 568 is coupled through a resistor R10 (47K) to control gating output terminal C1 for application to transducer 120. Thus, a pseudo-random signal is superimposed on the modulated tone signal when switch 560 is closed, to simulate firing of a laser or the like.

During the music mode of operation, a pseudo-random sequence of musical notes are generated. A high level music mode control signal is generated upon entry of a function select sequence of three (switch 210 is depressed three times). The music mode operation is associated with accessory musical instrument 20 and the music generated when switch 560 (in body 12 or in accessory 20) is closed.

Referring to FIG. 4, tone generator 114 generates a pseudo-random sequence of electrical tones. NAND gate 418 is enabled by the high level music control signal. Frequency gate 410 therefore provides a 64 KHz signal. NAND 458 is selective gating device 452 is also enabled by the music control signal. The output signals of decoder logic 432 are therefore applied as data inputs to flip flop 462. Decoder logic 432 generates output signals in response to pseudo-random one of predetermined counts. Accordingly, the frequency of the output signal of flip flop 464 varies pseudo-randomly. The pseudo-random electrical tones are provided at tone generator output terminal T2.

Referring now to FIG. 5, tone generator output terminal T2 is applied to one input terminal of a 2-input NAND gate 570. Gate 570 is enabled by the high level music mode control signal. The output of NAND gate 570 is applied to one input of a 2-input NOR gate 572. NOR gate 572 is enabled by inverter 568 upon closure of switch 560. The output terminal of NOR gate 572 is applied through a resistor R5 (150K) to control gating output terminal C1, for application to transducer 120. Thus, when switch 560 is closed during music mode operation, a pseudo-random sequence of musical notes is generated. The pseudo-random sequence of musical notes provides an eerie sound effect in keeping with the "mystic" nature of the toy 10.

Also in keeping with the mystical nature of toy 10, the oracle mode operation allows for toy 10 to "tell the future" or respond to inquiries. The oracle mode of operation is associated with a crystal ball accessory 22. An inquiry is made and switch 560 (here associated with crystal ball 22) closed, suitably by touching crystal ball 22. A random number (one, two, three or four) gongs sounds are then provided in apparent response to the inquiry. A high level oracle control mode signal is generated in response to a function select sequence entry of five.

During the oracle mode, tone generator 114 generates a multi-tone signal having frequency components at 256 Hz and 12 Hz. Referring to FIG. 4, NAND gate 416 of frequency gate 410 is enabled by the high level oracle mode control signal. Frequency gate 410 therefore provides a 4096 Hz signal. Similarly, NAND gate 456 of selecting device 452 is enabled. The output signals of decoder 430 are thus applied to flip flop 462. Accordingly, frequency divider 425 provides an output signal having a frequency equal to 4096 divided by 12 (341 Hz) NAND gate 420 of frequency gate 412 is also enabled by the high level oracle mode control signal. Frequency gate 412 therefore provides a 256 Hz output signal. Accordingly, exclusive OR gate 466 provides a multi-tone output signal at tone generator output terminal T1, having frequency components at 256 Hz and 341 Hz.

Referring now to FIG. 5, the multi-tone output signal produced at the tone generator output terminal T1 is applied to NAND gate 546 of logic 530 in control gating 116. The multi-tone signal is selectively applied to data gate 512 in accordance with the state of flip flop 558.

With respect to the oracle mode, switch 560 is suitably a momentary contact switch. When switch 560 is closed, and then opened, inverter 568 provides a transition to set RS flip flop 559. A high level signal is therefore applied to the data input of flip flop 558. Thus, upon the next 0.5 Hz clock pulse, flip flop 558 is set. The high level Q output enables NAND gates 546 and 552. NAND gates 542 and 540 of data gate 512 and control signal gate 514, respectively, are enabled by the high level oracle mode control signal. Accordingly, an inverted multi-tone signal and a low level signal are applied to modulator 118 as data and control signals, respectively.

Referring briefly now to FIG. 6, the low level control signal applied to exclusive OR gates 618-622 cause the respective different frequency signals to be passed uninverted to NOR gates 626-630. Accordingly, D/A converter 634 generates a signal which is, in effect, the multi-tone signal amplitude modulated with a waveform which progressively decreases from a maximum to a minimum value (decays) during each cycle of counter chain 604 of timing circuit 600. NAND gate 632 is enabled by the high level inverted breath mode control signal. The most significant bit is therefore activated to provide a relatively high amplitude signal. The modulated signal is applied to transducer 120. Transducer 120 produces a gong-like sound for each cycle of the modulated signal applied to transducer 120.

RS flip flop 559 is reset by a free running clock signal of predetermined frequency, 0.125 Hz ($CL_{19}$). The free running reset signal frequency is less than the frequencies of the modulation envelope. The data input of flip flop 558 thus receives a low level signal, and when next clocked by the 0.5 Hz ($\overline{CL}_{17}$) signal, flip flop 558 is reset. The high level $\overline{Q}$ output produced enables NAND gates 548 and 554. NAND gates 546 and 552 are inhibited. Accordingly, the pseudo-random signal from pseudo-random signal generator output terminal P5 and the 0.25 Hz ($CL_{18}$) signal are provided by logic circuit 530, and passed by data gate 512 and control gate 514, respectively. Modulator 118 therefore produces a pseudo-random signal having an amplitude envelope which alternately progressively rises and progressively decreases. The modulated signal is applied to transducer 120. The result is a crackling noise.

Thus, when the oracle mode is entered into prior to an inquiry (activation signal generated by closing switch 560) the crackling noise is produced. When switch 560 is closed, and flip flop 559 set, gong signals are generated until the free running clock signals resets flip flop 559. The relative frequencies of the gong signal modulation envelope and reset clock are chosen such that a plurality of cycles of the gong envelope signal can occur during one cycle of the reset clock signal. In the present example, up to four periods of the gong envelope can occur during one cycle of the reset signal. The number of gong signals actually produced is a function of the time interval between the closing of switch 560 and the next subsequent reset pulse. Since the time interval between closing of switch 560 and the generation of the next subsequent pulse is random, the response to the inquiry, i.e., the number of gongs produced, is random. It should be appreciated that all of the clock signals are generated by timing circuit 600, and accordingly, synchronization is provided. Flip flop 558 is clocked with the inverted $CL_{17}$ (0.5 Hz) signal produced by inverter 624. Accordingly, flip flop 558 changes state prior to the beginning of each modulation cycle. Thus, only complete gong signals are produced.

As noted above, an LED operational mode is also provided. Eye LED's 24 and 26 are initially activated upon application of power to circuit 14. The initialization signal resets flip flop 238 (FIG. 2) to generate a low level LED mode control signal to enable the LED driver circuitry. Referring now to FIG. 5, the pseudo-random signal produced at pseudo-random signal generator output terminal P4 is applied to a 2-input NAND gate 574. The other input terminal of NAND gate 574 is coupled to inverter 568 through a second inverter 576. Thus, a second 2-input NAND gate 578 is responsive to the output of inverter 568 and to an 8 Hz ($CL_{13}$) signal. The output terminals of NAND gates 574 and 578 are applied as input signals to a further 2-input NAND gate 580. The output of NAND gate 580 is applied to a 2-input NOR gate 582. NOR gate 582 is responsive to the LED mode control signal. The output of NOR gate 582 drives a transistor 584 to control the activation of LED's 24 and 26. Thus, when switch 560 is closed, NAND gate 574 is enabled, and the output of NAND gate 578 forced high. The pseudo-random signal is therefore applied through NAND gate 580 and NOR gate 582 to drive transistor 584. The eye LED's 24 and 26 thus flicker randomly. During LED mode operation, when switch 560 is open, the 8 Hz signal is utilized to drive transistor 584, and LED's 24 and 26 blink on and off at a 8 Hz rate.

It will be understood that the above description is of an illustrative embodiment of the present invention and that the invention is not limited to the specific form shown. For example, in practice, circuitry 14 would comprise a monolithic chip and a conventional speaker. As noted, any form of body 12 may be utilized. Similarly, other combinations of tones and frequencies may be provided. Various modifications can be made in the design and arrangement of the elements as will be apparent to those skilled in the art without departing from the scope of the invention as expressed in the appended claims.

What is claimed is:

1. An electronic doll comprising:

a body;

function select means, disposed on said body, for selectively generating respective mode control signals;

electronic signal generator means, disposed in said body and responsive to said mode control signals, including:

means for generating a wind simulation signal representative of the sounds of wind;

means for generating a breathing simulation signal representative of the sounds of breathing;

means for generating a weapons simulation signal representative of weapons fire;

means for generating pseudo-random musical notes; and means for generating one of a predetermined number of responses to an actuation signal, said one response being determined in a random manner;

transducer means for generating audible output signals representative of electrical input signals applied thereto; and means, responsive to said mode control signals, for selectively applying said respective electrical simulation signals as input signals to said transducer means.

2. The electronic doll of claim 1 wherein said means for generating a wind simulation signal comprises:

pseudo-random signal generator means, responsive to clock signals applied thereto for producing a pseudo-random signal, said pseudo-random signal having a digital value changing in a pseudo-random manner at a rate in accordance with said clock signal;

oscillator means for generating said clock signal at a frequency in accordance with a frequency control signal applied thereto; and irregular signal generator means, responsive to said pseudo-random signal, for generating an irregular signal which alternatively rises or falls in amplitude in an irregular manner, said irregular signal being applied to said oscillator means as said frequency control signal.

3. The electronic doll of claim 2 wherein said pseudo-random signal generator means comprises:

a shift register having a plurality of stages, a data input terminal, a clock input terminal and a plurality of output terminals associated with respective stages;

said shift register, in response to signals applied to said clock terminal, loading the first stage thereof in accordance with the signal applied at said data input terminal and the remainder of the stages thereof with the contents of the just previous stage, said shift register providing at said output terminals respective output signals indicative of the content of the respective stages associated with said output terminal; and a 2-input exclusive OR gate, the input terminals of said exclusive OR gate being coupled to respective output terminals of said shift register, and the output signals thereof being applied to said shift register data input terminal.

4. The electronic doll of claim 3 wherein said pseudo-random generator means further comprises an additional 2-input exclusive OR gate, one input thereof coupled to the output of the first mentioned exclusive OR gate, the other input thereof receptive of an initialization signal, and the output of said additional exclusive OR gate coupled to said shift register data input terminal.

5. The electronic doll of claims 2 or 3 wherein said means for generating a wind simulation signal further includes a frequency divider responsive to said pseudo-random signal, the output of said frequency divider being selectively applied to said transducer means as said wind simulation signal.

6. The electronic doll of claim 3 wherein said exclusive OR gate input terminals are coupled to the third and last shift register stages, respectively.

7. The electronic doll of claims 3, 4 or 5 wherein said means for generating said breathing simulation signal comprises:

means for inhibiting said means for generating said irregular signal, and for generating a squarewave signal of predetermined frequency, said squarewave signal being applied to said oscillator means as said frequency control signal;

a 2-input OR gate, the input terminals of said OR gate being coupled to respective output terminals of said shift register; and amplitude modulating means, responsive to said OR gate output signal, for modulating said OR gate output signal with a signal which alternately increases and decreases in amplitude, the modulated signal being selectively applied to said transducer means as said breathing simulation signal.

8. The electronic doll of claim 7 wherein said amplitude modulating means comprises:

counter means, for producing a plurality of respective different frequency signals in predetermined frequency relation;

a plurality of 2-input exclusive OR gates, each of said plurality of exclusive OR gates having a respective one of said different frequency signals applied thereto, the other inputs thereof having a signal indicative of a sub-harmonic of said different frequency signals selectively applied thereto; and a plurality of 2-input OR gates, each of said plurality of OR gates having the output signal a respective one of said plurality of exclusive OR gates applied thereto and the other input thereof having a signal indicative of the first mentioned 2-input OR gates selectively applied thereto; and a digital analog (D/A) converter, responsive to the respective output signals of said plurality of OR gates, the output signal of said D/A converter being applied to said transducer means as said breath simulation signal.

9. The electronic doll of claim 2 wherein said means for generating a breathing simulation signal comprises:

means for inhibiting said irregular signal and generating a bilevel signal, said bilevel signal alternating between first and second amplitude levels with predetermined frequency, said bilevel signal being applied to said oscillator means as said frequency control signal;

conbinatorial means, responsive to said pseudo-random signal, for generating a combined signal having first and second components each representative of said pseudo-random signal but delayed with respect to each other by a period in accordance with the frequency of said clock signal; and amplitude modulating means, responsive to said combined signal, for modulating said combined signal with a modulation signal which alternately increases and decreases in amplitude said modulated combined signal being selectively applied to said transducer means as said breath simulation signal.

10. The electronic doll of claim 9 wherein said amplitude modulating means comprises:

counter means, for producing a plurality of respective different frequency signals in predetermined frequency relation;

a plurality of 2-input exclusive OR gates, each of said plurality of exclusive OR gates having a respective one of said different frequency signals applied thereto, the other inputs thereof having a signal indicative of a sub-harmonic of said different frequency signals selectively applied thereto; and a plurality of 2-input OR gates, each of said plurality of OR gates having the output signal a respective one of said plurality of exclusive OR gates applied thereto and the other inputs thereof having a signal indicative of the first mentioned 2-input OR gates selectively applied thereto; and a digital analog (D/A) converter, responsive to the respective output signals of said plurality of OR gates, the output signal of said D/A converter being applied to said transducer means as said breath simulation signal.

11. The electronic doll of claim 7 wherein said amplitude modulating means comprises:

counter means, for producing a plurality of respective different frequency signals in predetermined frequency relation;

a plurality of 2-input exclusive OR gates, each of said plurality of exclusive OR gates having a respective one of said different frequency signals applied thereto, the other inputs thereof having a signal indicative of a desired alternation rate for amplitude increasing and decreasing selectively applied thereto; and a plurality of 2-input OR gates, each of said plurality of OR gates having the output signal a respective one of said plurality of exclusive OR gates applied thereto and the other inputs thereof having a signal indicative of the first mentioned 2-input OR gates selectively applied thereto; and a digital analog (D/A) converter, responsive to the respective output signals of said plurality of OR gates, the output signal of said D/A converter being applied to said transducer means as said breath simulation signal.

12. The electronic doll of claim 9 wherein said amplitude modulating means comprises:

counter means, for producing a plurality of respective different frequency signals in predetermined frequency relation;

a plurality of 2-input exclusive OR gates, each of said plurality of exclusive OR gates having a respective one of said different frequency signals applied thereto, the other inputs thereof having a signal indicative of a desired alternation rate for amplitude increasing and decreasing selectively applied thereto; and a plurality of 2-input OR gates, each of said plurality of OR gates having the output signal a respective one of said plurality of exclusive OR gates applied thereto and the other inputs thereof having a signal indicative of the first mentioned 2-input OR gates selectively applied thereto; and a digital analog (D/A) converter, responsive to the respective output signals of said plurality of OR gates, the output signal of said D/A converter being applied to said transducer means as said breath simulation signal.

13. The electronic doll of claim 2 wherein said means for generating a breathing simulation signal comprises:

means for inhibiting said irregular signal and generating a bilevel signal, said bilevel signal alternating between first and second amplitude levels with predetermined frequency, said bilevel signal being applied to said oscillator means as said frequency control signal;

combinatorial means, responsive to said pseudo-random signal, for generating a combined signal having first and second components each representative of said pseudo-random signal but delayed with respect to each other by a period in accordance with the frequency of said clock signal; and attack/decade means, responsive to said combined signal, for generating an output signal indicative of said combined signal, but having an amplitude which alternately progressively rises and progressively falls, said attack/decade means output signal being selectively applied to said transducer means as said breath simulation signal.

14. The electronic doll of claim 1 wherein said means for generating a breathing simulation signal comprises:

psuedo-random signal generator means, responsive to clock signals applied thereto for producing a pseudo-random signal, said pseudo-random signal having a digital value changing in a pseudo-random manner at a rate in accordance with said clock signal;

oscillator means for generating said clock signal at a frequency in accordance with a frequency control signal applied thereto; and means for generating a bilevel signal, said bilevel signal alternating between first and second amplitude levels with predetermined frequency, said bilevel signal being applied to said oscillator means as said frequency control signal;

combinatorial means, responsive to said pseudo-random signal, for generating a combined signal having first and second components each representative of said pseudo-random signal but delayed with respect to each other by a period in accordance with the frequency of said clock signal; and attack/decade means, responsive to said combined signal, for generating an output signal indicative of said combined signal, but having an amplitude which alternately progressively rises and progressively falls, said attack/decade means output signal being selectively applied to said transducer means as said breath simulation signal.

15. The electronic doll of claim 14 wherein said attack/decade means comprises:

amplitude modulating means, responsive to said combined signal, for modulating said combined signal with a modulation signal which alternately increases and decreases in amplitude, said modulated combined signal being selectively applied to said transducer means as said breath simulation signal.

16. The electronic doll of claim 14 wherein said pseudo-random signal generator means comprises:

a shift register having a plurality of stages, a data input terminal, a clock input terminal and a plurality of output terminals associated with respective stages;

said shift register, in response to signals applied to said clock terminal, loading the first stage thereof in accordance with the signal applied at said data input terminal and the remainder of the stages thereof with the contents of the just previous stage, said shift register providing at said output terminals respective output signals indicative of the content of the respective stages associated with said output terminal; and a 2-input exclusive OR gate, the input terminals of said exclusive OR gate being coupled to respective output terminals of said shift register, and the output signals thereof being applied to said shift register data input terminal.

17. The electronic doll of claim 16 wherein said combinatorial means comprises a 2-input OR gate, the input terminals of said OR gate being coupled to respective output terminals of said shift register.

18. The electronic doll of claim 15 wherein said amplitude modulating means comprises:

counter means, for producing a plurality of respective different frequency signals in predetermined frequency relation;

a plurality of 2-input exclusive OR gates, each of said plurality of exclusive OR gates having a respective one of said different frequency signals applied thereto, the other inputs thereof having a signal indicative of a sub-harmonic of said different frequency selectively applied thereto; and a plurality of 2-input OR gates, each of said plurality of OR gates having the output signal a respective one of said plurality of exclusive OR gates applied thereto and the other inputs thereof having a signal indicative of said combined signal selectively applied thereto; and a digital analog (D/A) converter, responsive to the respective output signals of said plurality of OR gates, the output signal of said D/A converter being applied to said transducer means as said breath simulation signal.

19. The electronic doll of claim 1 wherein said means for generating a weapons simulation signal comprises;

tone generator means, for generating an electrical tone signal having a predetermined frequency composition; and amplitude modulating means, responsive to said tone signal and the mode control signal corresponding to said weapons simulation, for selectively generating a modulated signal representative of said tone signal having a sawtooth amplitude envelope, said modulated signal being applied to said transducer means.

20. The electronic doll of claim 19 further including:

pseudo-random signal generator means, responsive to said mode control signal corresponding to said weapons simulation for generating signal bursts of predetermined frequency, said signal bursts being pseudo-random in duration and repetition rate; and means for selectively applying said signal bursts to said transducer in superposition with said modulated signal.

21. The electronic doll of claim 20 wherein said pseudo-random signal generator means comprises:

a shift register having a plurality of stages, a data input terminal, a clock input terminal and a plurality of output terminals associated with respective stages;

said shift register, in response to signals applied to said clock terminal, loading the first stage thereof in accordance with the signal applied at said data input terminal and the remainder of the stages thereof with the contents of the just previous stage, said shift register providing at said output terminals respective output signals indicative of the content of the respective stages associated with said output terminal;

a first 2-input NAND gate, the input thereof being coupled to respective output terminals of said shift register;

a D-type flip flop, having D and clock input terminals and an output terminal, said D-type flip flop generating at said output terminal in response to signals applied to said clock input terminal an output signal in accordance with the signal instantaneously applied at said D input terminal, said D input terminal being coupled to one output terminal of said shift register and said flip flop clock input terminal having applied thereto a signal of a first predetermined frequency; and a 4-input NAND gate, the respective input terminals of said 4-input NAND gate respectively having applied thereto, said mode control signal corresponding to said weapons simulation, said flip flop output signal, the output signal of said 2-input NAND gate, and a signal of a second predetermined frequency.

22. The electronic doll of claim 21 wherein said second predetermined frequency is twice said first predetermined frequency.

23. The electronic doll of claim 19 wherein said amplitude modulating means comprises:

counter means, for producing a plurality of respective different frequency signals in predetermined frequency relation;

a plurality of 2-input OR gates, each of said plurality of OR gates having a signal indicative of a respective one of said different frequency signals applied thereto, the other of said input terminals having selectively applied thereto a signal indicative of said tone signal; and a digital-to-analog (D/A) converter responsive to the respective output signals of said plurality of OR gates, the output signals of said D/A converter being applied to said transducer means.

24. The electronic doll of claim 8 wherein said means for generating a weapons simulation signal comprises:

tone generator means, for generating an electrical tone signal having a predetermined frequency composition; and means, responsive to the mode control signal corresponding to weapons simulation, for selectively applying a signal indicative of said tone signal to said other inputs of said plurality of OR gates and a high level to said other inputs of said plurality of exclusive OR gates.

25. The electronic doll of claim 24 wherein said means for generating a weapons simulation signal further comprises:

a first 2-input NAND gate, the input thereof being coupled to respective output terminals of said shift register;

a D-type flip flop, having D and clock input terminals and an output terminal, said D-type flip flop generating at said output terminal in response to signals applied to said clock input terminal an output signal in accordance with the signal instantaneously applied at said D input terminal, said D input terminal being coupled to one output terminal of said shift register and said flip flop clock input terminal having applied thereto a signal of a first predetermined frequency; and a 4-input NAND gate, the respective input terminals of said 4-input NAND gate respectively having applied thereto, said mode control signal corresponding to said weapons simulation, said flip flop output signal, the output signal of said 2-input NAND gate, and a signal of a second predetermined frequency.

26. The electronic doll of claim 25 wherein said second predetermined frequency is twice said first predetermined frequency.

27. The electronic doll of claim 8 wherein said means for generating one of a predetermined number of responses to an actuation signal comprises:

tone generator means, for generating an electrical tone signal having a predetermined frequency composition;

logic means, response to an accessory state control signal applied thereto and said mode control signal for selectively applying during a first accessory state, a signal indicative of said tone signal to said plurality of OR gates other input terminal and a low level signal to said plurality of exclusive OR gates other input terminals and, during a second accessory state, selectively applying a pseudo-random signal to said plurality of OR gates other input terminals and a signal of a second predetermined frequency to said plurality of exclusive OR gates other input terminals; and bistable means, responsive to a free running reset signal of a first predetermined frequency and said actuation signal, for generating an accessory state control signal indicative of said first accessory state in response to said actuation signal and an accessory stage control signal indicative of said second accessory state in response to said free running reset signal.

28. The electronic doll of claim 1 wherein said means for generating one of a predetermined number of responses to an actuation signal comprises:

tone generator means, for generating an electrical tone signal having a predetermined frequency composition;

first bistable means responsive to said actuation signal and a free running reset signal, for generating an output signal having a first state in response to said actuation signal and having a second state in response to said free running reset signal; and logic means responsive to said mode control signal and said bistable means output signal for generating a first output signal indicative of said tone signal during periods of said bistable means first state, the number of cycles of said tone signal manifested in said first output signal being determined by the time period between generation of said actuation signal and said free running reset signal.

29. The electronic doll of claim 28 wherein said bistable means comprises:

an RS flip flop having set and reset input terminals and an output terminal set responsive to said actuation signal and reset responsive to said free running reset signal;

a D flip flop having data and clock input terminals and an output terminal;

said D flip flop generating at said output terminal in response to signals applied to said clock input terminal, an output signal indicative of the signal applied at said data input terminal, said D flip flop having said RS flip flop output signal applied to the data input terminal thereof and a signal having a frequency greater than the frequency of said free running reset signal.

30. The electronic doll of claims 28, or 29, wherein said logic means further includes means for generating a second output signal during said bistable means second state.

31. The electronic doll of claim 30 wherein said logic means comprises:

first gating means, responsive to a signal indicative of said bistable means state for producing in response to said bistable means first set signal indicative of said tone signal, and in response to said bistable means second state producing a signal indicative of a pseudo-random signal;

second gating means, responsive to a signal indicative of said bistable means state, for producing a signal of predetermined constant state in response to said bistable means first state, and in response to said bistable means second state producing a signal having a predetermined frequency;

counter means, for producing a plurality of respective different frequency signals in predetermined frequency relation;

a plurality of 2-input exclusive OR gates, each of said plurality of exclusive OR gates having a respective one of said different frequency signals applied thereto having said second gating means output signals selectively applied thereto;

a plurality of 2-input OR gates, each of said plurality of OR gates having the output signal a respective one of said plurality of exclusive OR gates applied thereto and the other inputs thereof said first gating means output signals selectively applied thereto; and a digital analog (D/A) converter, responsive to the respective output signals of said plurality of OR gates, the output signal of said D/A converter being applied to said transducer.

32. The electronic doll of claim 1 wherein said means for generating said pseudo-random musical tones comprises:

a pseudo-random signal generator for generating a pseudo-random signal having a digital value changing in a pseudo-random manner;

counter means, for producing a plurality of output signals having respective different predetermined frequencies;

gating means, responsive to respective ones of said counter means output signals and signals indicative of said pseudo-random signal, for generating a tone output signal alternatively comprising portions indicative of said respective counter means output signals, said tone output signal being selectively applied to said transducer means as said pseudo-random musical notes.

33. A toy comprising:

a physical structure;

electronic means, disposed on said structure for generating a wind electrical simulation signal, transducer means for generating audible output signals representative of electrical input signals applied thereto, and means for selectively applying said wind simulation as an input signal to said transducer means, said electronic means comprising:

pseudo-random signal generator means, responsive to clock signals applied thereto, for producing a pseudo-random signal, said pseudo-random signal having a digital value changing in a pseudo-random manner at a rate in accordance with said clock signal said pseudo-random signal being selectively applied as electrical input signals to said transducer means;

oscillator means for generating said clock signal at a frequency in accordance with a frequency control signal applied thereto; and irregular signal generator means, responsive to said pseudo-random signal, for generating an irregular signal which alternatively rises or falls in amplitude in an irregular manner, said irregular signal being applied to said oscillator means as said frequency control signal.

34. The toy of claim 33 wherein said pseudo-random signal generator means comprises:

a shift register having a plurality of stages, a data input terminal, a clock input terminal and a plurality of output terminals associated with respective stages;

said shift register, in response to signals applied to said clock terminal, loading the first stage thereof in accordance with the signal applied at said data input terminal and the remainder of the stages thereof with the contents of the just previous stage, said shift register providing at said output terminals respective output signals indicative of the content of the respective stages associated with said output terminal; and a 2-input exclusive OR gate, the input terminals of said exclusive OR gate being coupled to respective output terminals of said shift register, and the output signals thereof being applied to said shift register data input terminal.

35. The toy of claim 34 wherein said pseudo-random generator means further comprises an additional 2-input exclusive OR gate, one input thereof coupled to the output of the first mentioned exclusive OR gate, the other input thereof receptive of an initialization signal, and the output of said additional exclusive OR gate coupled to said shift register data input terminal.

36. The toy of claims 33 or 34 wherein said means for generating a wind simulation signal further includes a frequency divider responsive to said pseudo-random signal, the output of said frequency divider being selectively applied to said transducer means as said wind simulation signal.

37. The toy of claim 34 wherein said exclusive OR gate input terminals are coupled to the third and last shift register stages, respectively.

38. The toy of claim 34 wherein said electronic means further includes means for generating a breathing simulation signal comprising:

means for inhibiting said means for generating said irregular signal, and for generating a squarewave signal of predetermined frequency, said squarewave signal being applied to said oscillator means as said frequency control signal;

a 2-input OR gate, the input terminals of said OR gate being coupled to respective output terminals of said shift register; and amplitude modulating means, responsive to said OR gate output signal, for modulating said OR gate output signal with a signal which alternately increases and decreases in amplitude, the modulated signal being selectively applied to said transducer means as said breathing simulation signal.

39. A toy comprising a body, electronic means for generating a breathing simulation signal and transducer means for generating audible output signals representative of electrical input signals applied thereto and means for selectively applying said breathing simulation signal as an input signal to said transducer means, said electronic means comprising:

pseudo-random signal generator means, responsive to clock signals applied thereto for producing a pseudo-random signal, said pseudo-random signal having a digital value changing in a pseudo-random manner at a rate in accordance with said clock signal;

oscillator means for generating said clock signal at a frequency in accordance with a frequency control signal applied thereto; and means for generating a bilevel signal, said bilevel signal alternating between first and second amplitude levels with predetermined frequency, said bilevel signal being applied to said oscillator means as said frequency control signal;

attack/decay means, responsive to said pseudo-random signal, for generating an output signal indicative of said pseudo-random signal, but having an amplitude which alternately progressively rises and progressively falls, said attack/decay means output signal being selectively applied to said transducer means as said breath simulation signal.

40. The toy of claim 39 or 57 wherein said attack-/decay means comprises:

amplitude modulating means, responsive to said pseudo-random signal, for modulating said pseudo-random signal with a modulation signal which alternately increases and decreases in amplitude, said modulated pseudo-random signal being selectively applied to said transducer means as said breath simulation signal.

41. The toy of claim 40 wherein said amplitude modulating means comprises:

counter means, for producing a plurality of respective different frequency signals in predetermined frequency relation;

a plurality of 2-input exclusive OR gates, each of said plurality of exclusive OR gates having a respective one of said different frequency signals applied thereto, the other inputs thereof having a signal indicative of a sub-harmonic of said different frequency signals selectively applied thereto; and a digital analog (D/A) converter, responsive to the respective output signals of said plurality of OR gates, the output signal of said D/A converter being applied to said transducer means as said breath simulation signal.

42. The toy of claim 39 or 57 wherein said pseudo-random signal generator means comprises:

a shift register having a plurality of stages, a data input terminal, a clock input terminal and a plurality of output terminals associated with respective stages;

said shift register, in response to signals applied to said clock terminal, loading the first stage thereof in accordance with the signal applied at said data input terminal and the remainder of the stages thereof with the contents of the just previous stage, said shift register providing at said output terminals respective output signals indicative of the content of the respective stages associated with said output terminal; and a 2-input exclusive OR gate, the input terminals of said exclusive OR gate being coupled to respective output terminals of said shift register, and the output signals thereof being applied to said shift register data input terminal.

43. The toy of claim 42 wherein said pseudo-random signal generator further comprises a 2-input OR gate, the input terminals of said OR gate being coupled to respective output terminals of said shift register, whereby said pseudo-random signal includes first and second components each representative of the content of said shift register but delayed with respect to each other by a period in accordance with the frequency of said clock signal.

44. An electronic toy comprising:

a body;

function select means, disposed on said body for selectively generating mode control signals corresponding to respective operational modes of said toy;

electronic means, disposed on said body and responsive to said mode control signals for selectively generating respective electrical simulation signals; and transducer means for generating audible output signals representative of electrical input signals applied thereto; and means, responsive to said mode control signals, for selectively applying said respective electrical simulation signals as input signals to said transducer means, said electronic means comprising:

pseudo-random signal generator means, responsive to clock signals applied thereto for producing a pseudo-random signal, said pseudo-random signal having a digital value changing in a pseudo-random manner at a rate in accordance with said clock signal;

clock signal generator means, responsive to said mode control signals for generating a clock signal to said pseudo-random signal generator means, the frequency characteristics of said clock signal being in accordance with the operational mode of said toy;

modulating means, responsive to data input and control input signals applied thereto, for generating an analog signal indicative of said data input signal modulated with a sawtooth waveform signal, said sawtooth waveform progressively increasing in amplitude or progressively decreasing in amplitude in accordance with said control signal;

transducer means for generating audible output signals representative of electrical input signals applied thereto;

first logic means, responsive to said mode control signals, for selectively applying a signal indicative of said pseudo-random signal generator as a data input signal to said modulating means and selectively applying a bilevel signal of predetermined frequency as a control signal to said modulating means, said analog signal being applied to said transducer means whereby said transducer means provides a simulation of breathing.

45. The electronic toy of claim 44 wherein said clock generator means includes means responsive to a wind mode control signal from said function select means for selectively generating a clock signal having a frequency which changes in a pseudo-random manner, and said electronic means further comprises:

second logic means, responsive to said mode control signals, for selectively applying a signal indicative of said pseudo-random generator signal to said transducer means to produce a simulation of the sound of wind.

46. The electronic toy of claim 44 wherein said electronic means further comprises:

tone generaor means, responsive to said mode control signals, for selectively generating respective tone signals of predetermined frequency composition in accordance with said toy operational modes;

second logic means, responsive to a weapons mode control signal from said function select means for selectively applying said tone signals as a data input signal to said modulation means and selectively applying a signal of predetermined amplitude as a control signal to said modulating means, said analog signal being applied to said transducer means to produce simulation of weapons sounds.

47. The electronic toy of claim 46 wherein said electronic means further comprises:

free running means for generating a free running clock signal;

third logic means, responsive to an oracle mode control signal from said function select means, said free running clock signal and an activation signal applied thereto for selectively applying, during periods of oracle mode operation between generation of said actuation signal and generation of said free running clock signal to said modulator means and selectively applying a signal of predetermined amplitude control signal to said modulator means, said analog signal being applied to said transducer means to generate a pseudo-random number of distinct notes in accordance with the number of cycles of said tone generated in said period.

48. The electronic toy of claim 47 wherein said third logic means includes means for selectively applying, during oracle mode operation periods not between generation of said actuation signal and generation of said free running clock signal, a signal indicative of said pseudo-random generation signal to said modulator means as a data input signal and applying a signal of predetermined frequency less than the frequency of said free running clock signal to said modulator means as a control signal.

49. The electronic toy of claim 44 wherein said electronic means further comprises:

tone generator means, responsive to a music mode control signal from said function select means, and a signal indicative of said pseudo-random generator signal, for generating a sequence of musical note signals, said musical note signals changing in frequency in a pseudo-random manner, and means, responsive to said actuation signal applied thereto for selectively applying said musical note signal to said transducer means.

50. The electronic toy of claim 46 wherein said electronic means further includes:

third logic means, responsive to said weapons mode control signal and an actuation signal applied thereto for selectively applying a signal indicative of said pseudo-random signal to said transducer means in superposition with said analog signal.

51. The electronic toy of claims 47, 49 and 50 wherein said toy further comprises:

accessory means, adapted for removable interconnection into said electronic means, for generation of said actuation signal.

52. A toy doll comprising:

a body;

electronic means disposed on said body for generating a pseudo-random signal having an amplitude envelope which alternately progressive increases and decreases;

transducer means disposed on said body for generating audible output signals representative of electrical input signals applied thereto; and means, disposed on said body for selectively applying said pseudo-random signal to said transducer means as an input signal to produce a simulation of the sound of breathing.

53. An electronic toy comprising:

a body;

function select means for generating respective mode control signals indicative of respective operational modes of said toy;

pseudo-random signal generator means, responsive to said mode control signals for selectively generating a plurality of pseudo-random signals;

tone generator means, responsive to said mode control signals for selectively generating a plurality of tone signals;

modulator means, responsive to a data signal and a control signal applied thereto, for generating a modulated output signal indicative of said data signal modulated by a waveform in accordance with said control signal;

transducer means, for generating audible output signals representative of electrical input signals applied thereto; and control logic means, responsive to said mode control signals, and said tone signals for selectively generating data signals and control signals to said modulator means, and for selectively effecting application of said modulated signal to said transducer means as an input signal, whereby said toy provides a plurality of sounds respectively associated with said operational modes of said toy.

54. The electronic toy of claim 53 wherein said function select means comprises:

switch means for selectively generating a number of pulses in accordance with the desired operational mode of the toy;

a counter for counting the number of pulses generated by said switching means;

latch means for selectively storing the contents of said counter;

means, responsive to said switch means pulses, for generating a first control signal to reset said counter in response to the first switch means pulse, and for generating a second control signal to effect loading of said latch means when no switch means pulses are produced within a predetermined time period; and decoder means for generating a mode control signal on one of a plurality of mode control output lines in accordance with the contents of said latch means.

55. The electronic toy of claim 54 wherein said function select means further comprises at least one flip flop coupled to one of said mode control output lines, for toggling in state in response to signals applied on said one mode control line, the output of said flip flop being provided as one of said mode control signals.

56. The electronic toy of claim 55 wherein said function select means further includes initialization means for providing an initialization signal upon application of power to said toy, said initialization signal being applied to preset said flip flop.

57. The toy of claim 52 wherein said electronic means comprises:

pseudo-random signal generator means, responsive to clock signals applied thereto for producing a pseudo-random signal, said pseudo-random signal having a digital value changing in a pseudo-random manner at a rate in accordance with said clock signal;

oscillator means for generating said clock signal at a frequency in accordance with a frequency control signal applied thereto; and means for generating a bilevel signal, said bilevel signal alternating between first and second amplitude levels with predetermined frequency, said bilevel signal being applied to said oscillator means as said frequency control signal;

attack/decay means, responsive to said pseudo-random signal, for generating an output signal indicative of said pseudo-random signal, but having an amplitude which alternately progressively rises and progressively falls, said attack/decay means output signal being selectively applied to said transducer means as said breath simulation signal.

58. An electronic doll comprising:

a body;

function select means, disposed on said body, for selectively generating respective mode control signals;

electronic signal generator means, disposed in said body and responsive to said mode control signals, including:

means for generating a breathing simulation signal representative of the sounds of breathing;

means for generating a weapons simulation signal representative of weapons fire;

means for generating pseudo-random musical notes; and means for generating one of a predetermined number of responses to an actuation signal, said one response being determined in a random manner;

transducer means for generating audible output signals representative of electrical input signals applied thereto; and means, responsive to said mode control signals, for selectively applying said respective electrical simulation signals as input signals to said transducer means.

59. An electronic doll comprising:

a body;

function select means, disposed on said body, for selectively generating respective mode control signals;

electronic signal generator means, disposed in said body and responsive to said mode control signals, including:

means for generating a breathing simulation signal representative of the sounds of breathing;

means for generating a weapons simulation signal representative of weapons fire;

transducer means for generating audible output signals representative of electrical input signals applied thereto; and means, responsive to said mode control signals, for selectively applying said respective electrical simulation signals as input signals to said transducer means.

60. The electronic doll of claim 58 wherein said means for generating one of a predetermined number of responses to an actuation signal comprises:

tone generator means, for generating an electrical tone signal having a predetermined frequency composition;

first bistable means responsive to said actuation signal and a free running reset signal, for generating an output signal having a first state in response to said actuation signal and having a second state in response to said free running reset signal; and logic means responsive to said mode control signal and said bistable means output signal for generating a first output signal indicative of said tone signal during periods of said bistable means first state, the number of cycles of said tone signal manifested in said first output cycles of said tone signal manifested in said first output signal being determined by the time period between generation of said actuation signal and said free running reset signal.

61. The electronic doll of claim 60 wherein said bistable means comprises:

an RS flip flop having set and reset input terminals and an output terminal set responsive to said actuation signal and reset responsive to said free running reset signal;

a D flip flop having data and clock input terminals and an output terminal;

said D flip flop generating at said output terminal in response to signals applied to said clock input terminal, an output signal indicative of the signal applied at said data input terminal, said D flip flop having said RS flip flop output signal applied to the data input terminal thereof and a signal having a frequency greater than the frequency of said free running reset signal.

62. An electronic toy comprising:

a body;

function select means for generating respective mode control signal indicative of respective operational modes of said toy;

signal generator means, responsive to said mode control signals, for selectively generating a plurality of electrical signals;

modulator means, responsive to a data signal and a control signal applied thereto, for generating a modulated output signal indicative of said data signal modulated by a waveform in accordance with said control signal;

transducer means, for generating audible output signals representative of electrical input signals applied thereto; and control logic means, responsive to said mode control signals, and said electrical signals for selectively generating data signals and control signals to said modulator means, and for selectively effecting application of said modulated signal to said transducer means as an input signal, whereby said toy provides a plurality of sounds respectively associated with said operational modes of said toy.

* * * * *